US006492591B1

(12) United States Patent
Metcalf

(10) Patent No.: US 6,492,591 B1
(45) Date of Patent: Dec. 10, 2002

(54) MOVABLE ELECTRICAL AND DATA SERVICES MODULE

(75) Inventor: Keith E. Metcalf, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 09/878,467

(22) Filed: Jun. 11, 2001

(51) Int. Cl.[7] ..... H01H 13/04

(52) U.S. Cl. ..... 174/53; 174/50; 174/58; 174/48; 220/3.2

(58) Field of Search ..... 174/48, 49, 53, 174/50, 54, 55, 58, 61, 68.3, 60, 67, 95, 99; 220/32, 33, 35, 37, 3.92, 4.01, 4.02; 52/220.1, 220.3, 220.7; 439/207, 210, 211, 214, 215

(56) References Cited

U.S. PATENT DOCUMENTS

| | | | | | |
|---|---|---|---|---|---|
| 4,217,018 | A | * | 8/1980 | Yoshida et al. | 439/118 |
| 4,307,435 | A | * | 12/1981 | Ullman | 361/622 |
| 4,688,491 | A | * | 8/1987 | Herrera et al. | 174/152 G |
| 4,729,742 | A | * | 3/1988 | Onishi et al. | 439/208 |
| 4,758,687 | A | * | 7/1988 | Lathrop | 174/53 |
| 4,792,881 | A | | 12/1988 | Wilson et al. | 361/428 |
| 4,797,507 | A | * | 1/1989 | Lofving | 174/48 |
| 4,899,018 | A | * | 2/1990 | Sireci | 174/48 |
| 5,008,491 | A | * | 4/1991 | Bowman | 174/48 |
| 5,086,194 | A | * | 2/1992 | Bruinsma | 174/48 |
| 5,122,069 | A | * | 6/1992 | Brownlie et al. | 174/53 |
| 5,183,406 | A | * | 2/1993 | Glen | 439/120 |
| 5,230,552 | A | | 7/1993 | Schipper et al. | 312/223.6 |
| 5,231,562 | A | | 7/1993 | Pierce et al. | 361/428 |
| 5,516,298 | A | | 5/1996 | Smith | 439/131 |
| 5,575,668 | A | | 11/1996 | Timmerman | 439/131 |
| 5,593,317 | A | | 1/1997 | Humbles | 439/502 |
| 5,709,156 | A | | 1/1998 | Gevaert et al. | 108/50 |
| 5,765,932 | A | | 6/1998 | Domina et al. | 312/223.6 |
| D407,374 | S | | 3/1999 | Byrne | D13/139.4 |
| 5,954,525 | A | | 9/1999 | Siegal et al. | 439/131 |
| 5,971,508 | A | | 10/1999 | Deimen et al. | 312/223.6 |
| 6,028,267 | A | | 2/2000 | Byrne | 174/59 |
| D421,961 | S | | 3/2000 | Muller | D13/139.4 |
| 6,042,426 | A | | 3/2000 | Byrne | 439/654 |
| 6,085,667 | A | | 7/2000 | Gevaert et al. | 108/50.02 |

OTHER PUBLICATIONS

Open Space, The Wiremold Company, 1 pg.
Communications Cable Management, Kimball International, 1 pg.

* cited by examiner

*Primary Examiner*—Dean A. Reichard
*Assistant Examiner*—Angel R. Estrada
(74) *Attorney, Agent, or Firm*—Baker & Daniels

(57) ABSTRACT

An electrical and data services module to provide access to additional electrical and data receptacles which is used in conjunction with a flat work surface and a channel adjacent at least a portion of the flat work surface. The electrical and data services module has a first portion with at least one aperture therein for access to a power or data receptacle. The module also has a second portion which is slidably disposed in the channel, thereby allowing a user to easily move the module from one location to another in the channel.

17 Claims, 6 Drawing Sheets

MOVABLE ELECTRICAL AND DATA SERVICES MODULE

BACKGROUND OF THE INVENTION

1. Field of Invention

The resent invention relates to electrical and data services modules, specifically, electrical and data services modules for use in office and home workstations.

2. Description of the Related Art

As the office and the home become more dependent upon electrical and data equipment, such as computers and their associated peripheral devices, fax machines, copiers and other equipment, the need for additional electrical and data receptacles is readily apparent.

Prior methods of providing additional electrical and data receptacles include power strips which were "daisy-chained" together in a manner in which the power cord plug of one outlet strip is plugged into another power strip, or systems which incorporated additional receptacles into a work surface or a piece of furniture. However, both of these approaches present several problems.

Chains of power strips are unsightly as well as inconvenient since each receptacle, and each power strip, is limited in its electrical loading by its current rating, such that connection of many more pieces of electrical and data equipment than anticipated could overload such circuits and inconveniently trip the circuit breakers thereof. Furthermore, chains of power strips require large amounts of floor space, which could be used for other furniture or other devices. Incorporation of additional electrical and data receptacles in a work surface or a piece of furniture limits the placement of the electrical and data equipment. Additionally, each piece of equipment has a relatively short power cord and the receptacles included in the work surface or piece of furniture are not movable, thus one must move the equipment to meet the receptacles.

Another approach, which is similar to the incorporation of the receptacles within the furniture, is the use of a device in which a housing is permanently located within a work surface with a rotatable receptacle module disposed therein such that the rotatable module is rotated to expose the receptacles when needed. In a similar vein, other devices may include a cover over the receptacles which is flush with a work surface and is flipped up to reveal the receptacles when additional receptacles are needed. These devices, as with incorporating the receptacles in the work surface, are permanently located, thus the equipment must be moved closer to the receptacles for electrical connection.

Another structure used to provide additional receptacles is a module that is placed on a work surface edge with the edge "clamped" between the arm portions of the module. While this module may provide additional outlets to locations of the work surface near the edge thereof, this structure would not be suitable for locations on a work surface adjacent a wall or modular panel of a workstation.

A similar module also manufactured by Electric-Cable Assemblies, is "clamped" around an edge of the work surface. This module utilizes a thin extension placed between an edge of the work surface and a vertical wall, and a brace attached to the extension and extending to the underside of the work surface to provide a stable mounting mechanism for the module. While this module may provide additional receptacles, moving the module requires a user to remove the brace before moving the module and extension to a different location, followed by reattaching the brace, such that relocating the module is difficult.

Yet another approach is to place a hemispherical shaped module, having additional electrical or data receptacles, in a grommet hole in a work surface. Such a module is disclosed in U.S. Pat. No. 6,042,426. The module may comprise two halves, which are joined by protrusions extending from a back surface to form one structure that is inserted in a round grommet hole in a work surface. If each half were placed in a channel or space, the protrusions extending from the back surface thereof would prevent the module half from abutting a vertical surface. Additionally, the hemispherical structure would prevent secure placement in a channel or space and the module half would rock right and left as a user plugged into or removed a plug from the receptacle.

In light of the difficulties associated with the prior approaches, what would be desirable is a device including electrical and data receptacles, which is easily located and moved.

SUMMARY OF THE INVENTION

An electrical and data services module to provide access to additional electrical and data receptacles is provided which is used in conjunction with a flat work surface and a channel adjacent at least a portion of the flat work surface. The electrical and data services module has a first portion with at least one aperture therein for access to a power or data receptacle. The module also has a second portion which is slidably disposed in the channel, thereby allowing a user to easily move the module from one location to another in the channel.

The first portion of the module has an angled planar front surface with at least one coplanar aperture therein and at least one receptacle behind the aperture. The first portion also includes a vertical flat back surface, which abuts a vertical wall or modular panel. The bottom of the first portion also includes a substantially flat bottom surface which extends forwardly of the second portion and rests on a work surface when the second portion is disposed in the channel. The second portion has a planar forwardly facing front surface and a flat backwardly facing surface defined by the back surface of the first portion. The second portion also includes an aperture in a bottom surface thereof for receipt of electrical cables connected to the receptacles.

The channel includes a flexible flap, which covers the channel when a module is not placed within the channel. The flap is forced downwardly by the second portion of the module into the channel when a module is placed therein, and provides a "grip" which maintains the module securely in the channel.

The module may be provided with a cover that is hingedly mounted to the first portion. The cover has a first, closed position wherein the receptacle is not accessible to the user and a second, open position wherein the receptacle is accessible to the user. When the cover is in the closed position, debris and dust are prevented from entering the module, thereby protecting the receptacles when not in use.

The movable electrical and data services module is advantageous over the prior approaches since the module may be easily moved closer to office equipment, thereby eliminating the need to move such equipment closer to the receptacles or to have the equipment located near the receptacles in potentially awkward positions. The angled front surface allows a user to easily access the receptacles for plugging in the equipment or removing the plugs from the receptacles. Additionally, since the module is used in conjunction with a channel, the module is placed along the outer periphery of the work surface, as opposed to a grommet hole, which would place the module in an inconvenient location closer to the middle of the work surface.

The present invention provides an electrical and data services module for placement within a space defined between a substantially horizontal work surface and a substantially vertical wall surface, including a housing having a first portion and a second portion protruding from an underside of the first portion. The first portion has a substantially flat vertical back surface and a planar front surface being at an acute angle with respect to the back surface, the front surface having at least one aperture therein for receipt of a receptacle.

The present invention further provides a workstation including a substantially flat work surface, a substantially vertical wall surface, a channel between the work surface and the wall surface, the channel abutting at least a portion of an edge of the work surface, and a movable electrical and data services module. The module has a housing including a first portion having a planar front surface with at least one aperture therein, and a second portion protruding from an underside of the first portion and slidably disposed within the channel.

The present invention also provides in combination, a work surface, a substantially vertical wall surface adjacent the work surface, a space defined between the work surface and the wall surface, and a movable electrical and data services module. The module includes a housing having a first portion and a second portion protruding from an underside of the first portion, the first portion having a planar front surface having at least one aperture therein, the second portion slidably disposed within the space.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION

Figure 7:
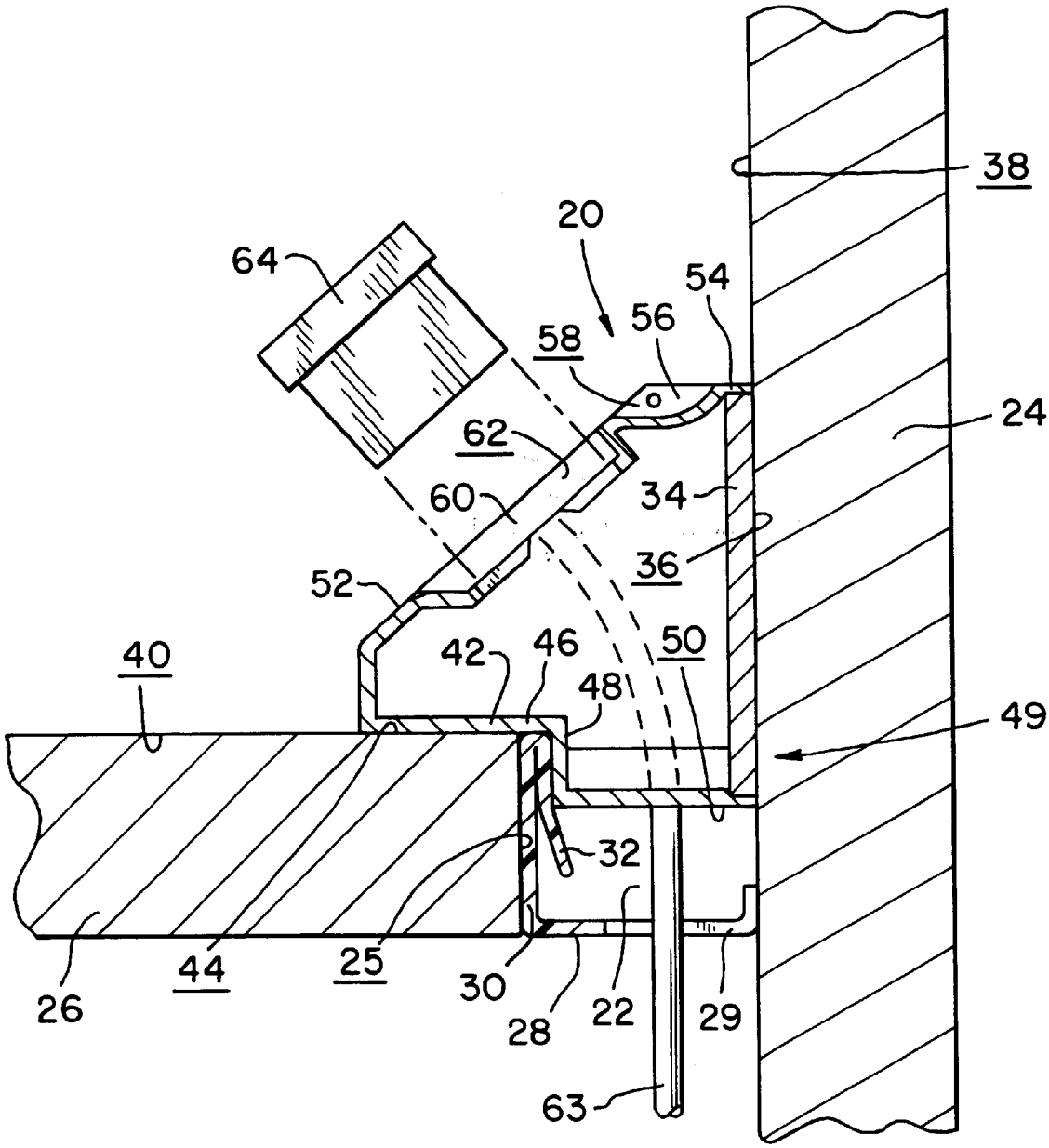
FIG. 7 is a sectional view of the module of FIG. 1A taken along line 7—7 of FIG. 2 further showing the module disposed within a channel between a wall and a work surface.
Figure 10:
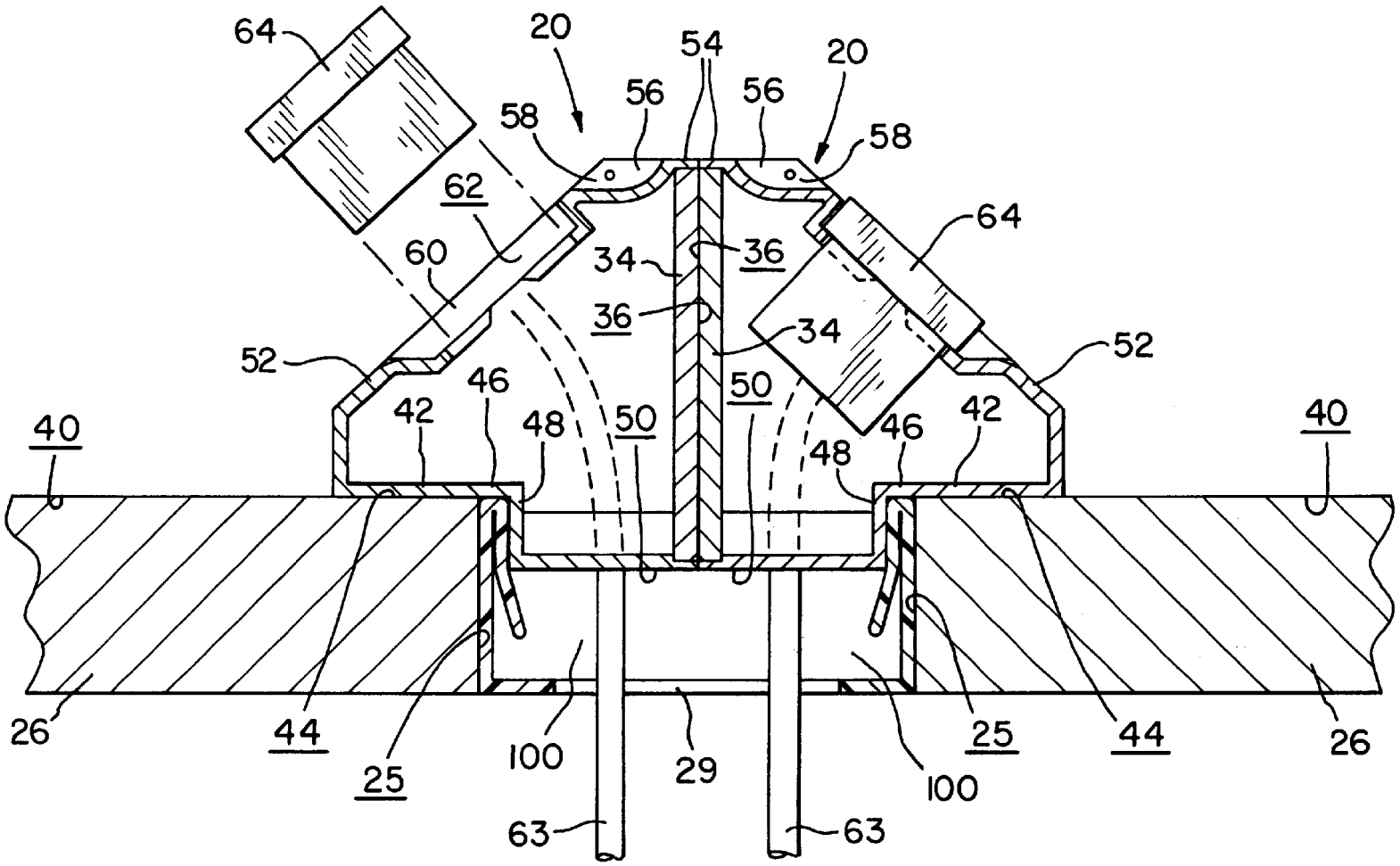
FIG. 10 is a sectional view of two modules of FIG. 1A taken along line 7—7 of FIG. 2 further showing the Two modules being disposed in a grommet hole in a work surface.

Referring first to FIG. 7, electrical and data services module 20 is shown disposed within channel 22 which is located between work surface 26 and vertical wall 24. Vertical wall 24 may be part of a modular panel, such as that disclosed in U.S. Pat. Nos. 4,907,384 and 4,918,886, each assigned to the assignee of the present application, the disclosures of which are incorporated herein by reference. Channel 22 may be a commercially available cable channel such as that disclosed in U.S. Pat. No. 4,535,703, assigned to the assignee of the present application the disclosure of which is incorporated herein by reference. As shown in FIG. 10, two modules 20 may be placed in a conventional round grommet hole 100 in work surface 26 with their respective back portions 34, or back surfaces 36, abutting each other. Rounded comers 51 (FIGS. 1A–2, 4, 8) provide engagement points with at least a portion of the round grommet hole and pilot modules 20 into the round grommet hole to ensure a close fit.

Channel 22 includes bottom 28, which has apertures 29 therein for receipt of electrical cords or data cables which lie within channel 22, and side wall 30, which abuts edge 25 of work surface 26. Channel 22 further includes rubber flap 32 which covers the sections of channel 22 in which a module 20 is not placed. As shown in FIG. 7, when module 20 is placed within channel 22, the section of flap 32 which covers the corresponding section of channel 22 is forced downward to abut sidewall 30. Additionally, by forcing flap 32 downward into channel 22, flap 32 provides a compressible grip to hold module 20 securely within channel 22 through flap 32 filling any space between the front wall of channel 22 and portion 48 of module 20. It should be noted that flap 32 comprises a flexible material, such as a compressible rubber material, while channel 22 comprises an inflexible material, such as a rigid plastic material.

Back portion 34 of module 20 is adjacent vertical wall 24 with surface 36 of back portion 34 abutting surface 38 of vertical wall 24. In a similar vein, surface 44 of bottom portion 42 of module 20 abuts surface 40 of work surface 26. Bottom portion 42 of module 20 actually comprises two distinct portions: a first portion 46 and a second protruding portion 49 which includes bottom surface 50 and vertical portion 48. Vertical section 48 abuts flap 32 when protruding portion 49 is maintained within channel 22. Module 20 also includes front 52 and top 54. Top 54 has a recessed portion 56 that is used to receive cover 78 (FIG. 1B) and recessed portion 56 has surfaces 58 along the sides thereof which receive connection devices for cover 78. Front 52 defines recesses 60, each having surface 62, which abut receptacles 64, 65, described hereinbelow.

Referring now to FIGS. 1A, 1B, 2, 3 and 4, module 20 is shown in respective perspective, front, top and side views. Module 20, as described above, includes recessed portion 56 (FIG. 7) in top 54. Recessed portion 56 further includes bottom surface 68, which interfaces with cover 78, and holes 82 in side surfaces 58 for receipt of connections to cover 78.

Figure 1A:
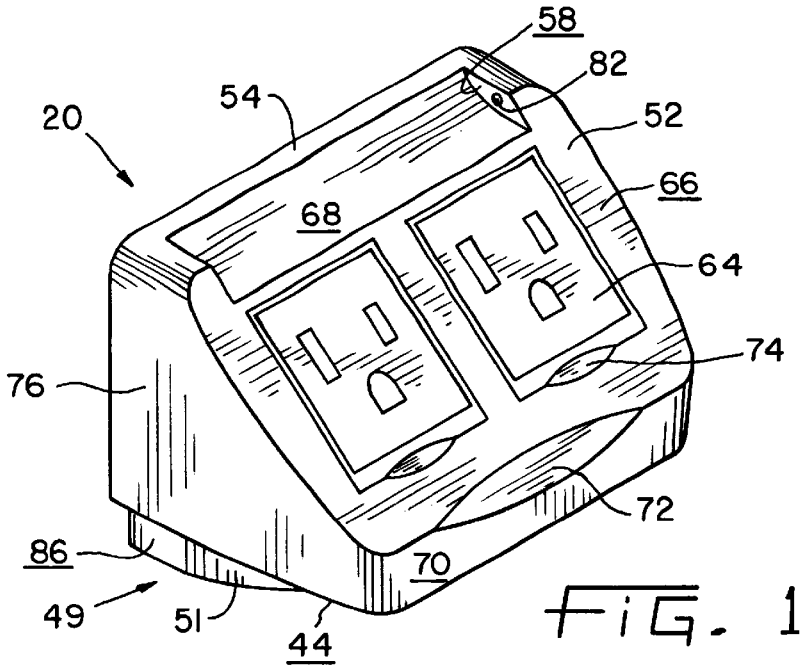
FIG. 1A is a perspective view of an electrical and data services module in accordance with the present invention, with the cover removed.
Figure 1B:
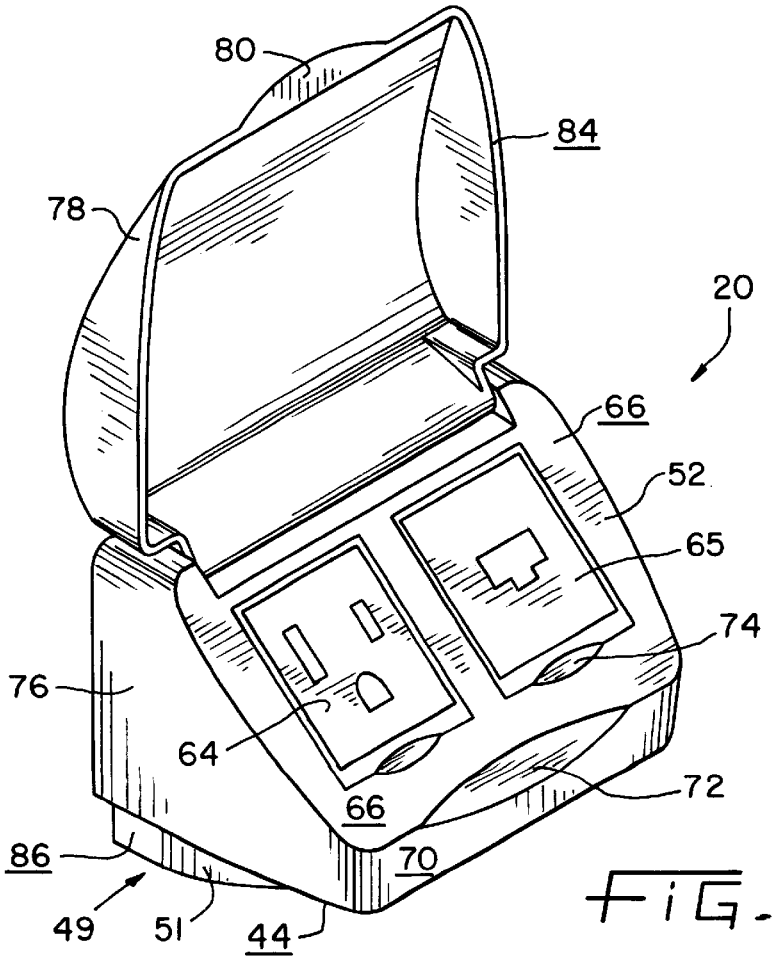
FIG. 1B is a perspective view of the electrical and data services module, with the cover attached.

As best seen in FIG. 1B, removable cover 78 has extending portion 80 which extends over recessed portion 72 when cover 78 is closed covering surface 66 and receptacles 64, 65. Cover 78 is moveable about an axis extending across recessed portion 56 through holes 82 from an open position, as shown in FIG. 1B, to a closed position. When cover 78 is closed, bottom edge surface 84 of cover 78 abuts surface 66 of front portion 52 to prevent an accumulation of dust or other debris in receptacles 64, 65 when module 20 is not in use. As shown in FIG. 1B, cover 78 has a curved profile, for example; however, cover 78 may have any profile suitable for covering receptacles 64, 65 and surface 66.

Front 52 of module 20 includes surface 66, which is angled relative to back 34 of module 20, and surface 70, which is a short vertical surface and adjoins surface 66 and surface 44 of bottom 42. Between surfaces 66 and 70 is slightly recessed portion 72 located below receptacles 64, 65. Recessed portion 72 allows one to place a finger under extending portion 80 of cover 78 to lift cover 78. Module 20 further includes two respective side portions 76 which, as shown in FIG. 4, are generally triangular in shape.

Figure 2:
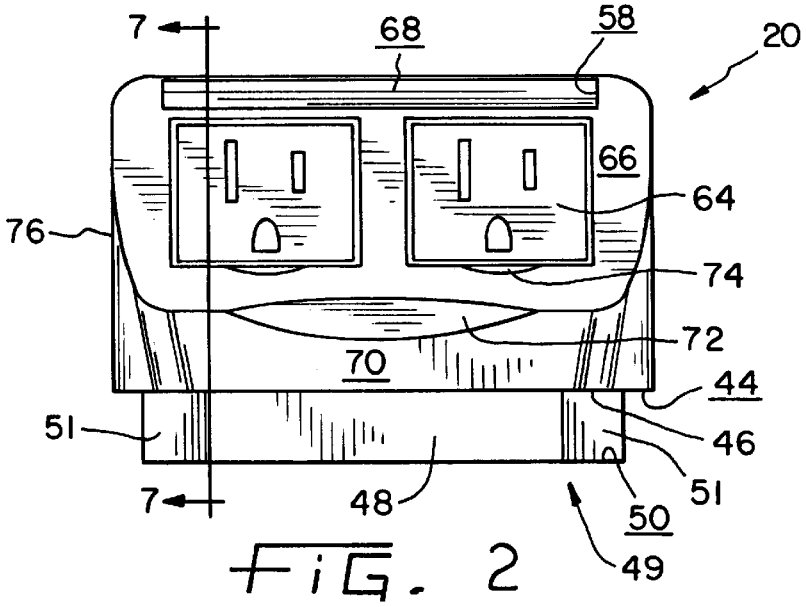
FIG. 2 is a front view of the module of FIG. 1A.
Figure 3:
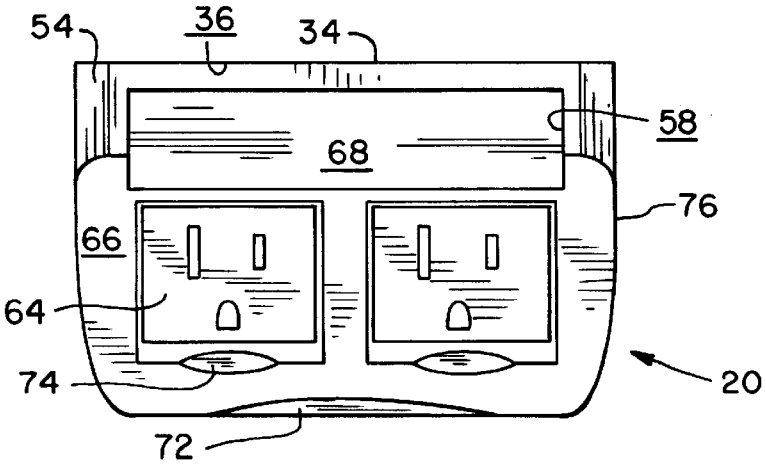
FIG. 3 is a top view of the module of FIG. 1A.
Figure 4:
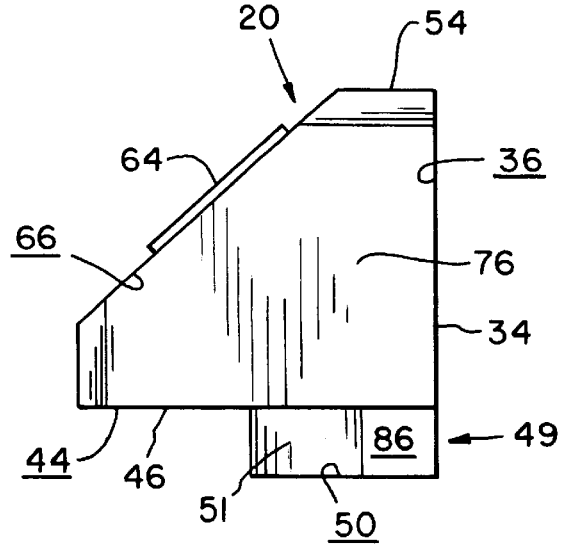
FIG. 4 is a side view of the module of FIG. 1A.
Figure 8:
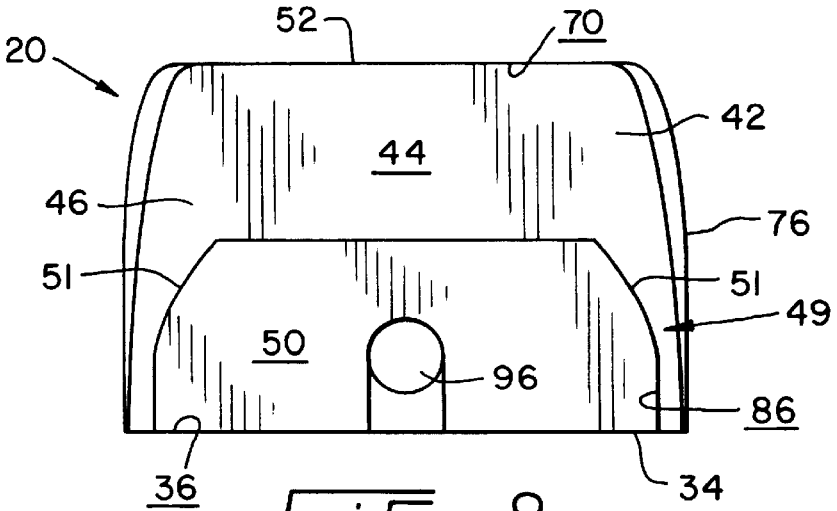
FIG. 8 is a bottom view of the module of FIG. 1A.

As best seen in FIG. 4, bottom 42 of module 20 includes side surfaces 86 between section 48 of bottom 42 and back 34. Protruding portion 49 does not extend across the full width of module 20, as shown in FIGS. 2 and 8. Protruding portion 49 is less than the full width and depth of module 20 to enable bottom 42 to have a protruding portion which is received in a grommet hole or channel 22 and a portion which sits on work surface 26. Protruding portion 49 is thus dimensioned to securely seat in channel 22. Overhanging surface 46 prevents module 20 from falling through a grommet hole or sitting too far down in channel 22. Thus, the structure of module 20, with portions 46 and 49, allows secure placement of module 20 in channel 22 or a grommet hole but does not require screws or other fastening devices to maintain the position of module 20, thereby allowing module 20 to be easily relocated along channel 22. With reference to FIG. 8, it should be noted that bottom surface 50 includes aperture 96 through which electrical wires or cords 63 for connection to removable receptacles 64, 65 may be inserted so that removable receptacles 64, 65 may be used.

Figure 5:
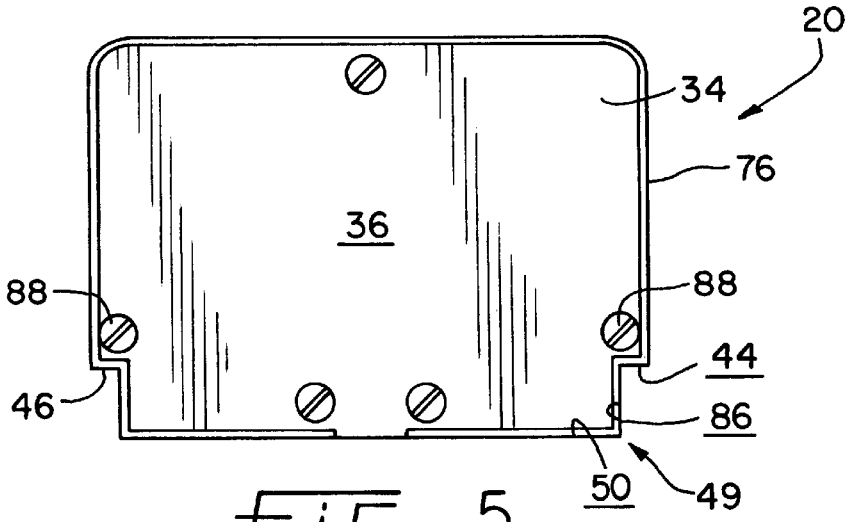
FIG. 5 is a rear view of the module of FIG. 1A with the back portion attached.
Figure 6:
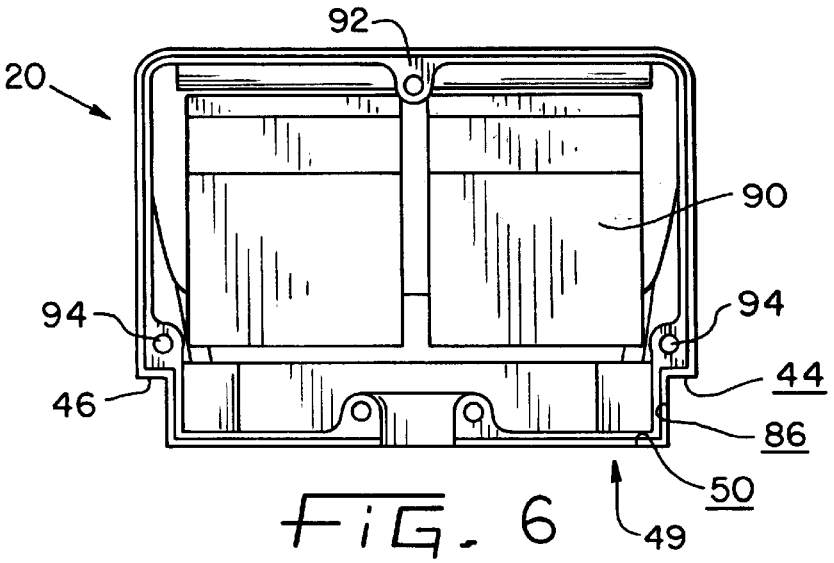
FIG. 6 is a back view of the module of FIG. 1A with the back portion removed.

Referring now to FIGS. 5 and 6, module 20 is depicted in a rear view. In FIG. 5, back 34 is attached to the body of module 20 by means of screws 88. In FIG. 6, back 34 has been removed revealing flange 92 on the inner periphery of the body of module 20; flange 92 includes screw holes 94 for receipt of screws 88 for assembly of module 20. Also shown in FIG. 6 are apertures 90 in front 52, which are used for receipt of removable receptacles 64, 65. As used in this application the term "receptacle" includes both electrical outlets and data outlets, such as those used for phone jacks, modems, or Ethernet connections, as well as any other electrical and data connection. It should be noted the receptacles may include all electrical receptacles 64, all data receptacles 65 or any combination thereof, such as the combination shown in FIG. 1B with a data receptacle 65 and an electrical receptacle 64.

Referring again to FIGS. 6 and 7, the operation of module 20 will now be described. Prior to placement of module 20 in channel 22, receptacles 64, 65 are inserted in apertures 90. In the case of electrical receptacles 64, cord 63, which is attached to receptacle 64, is inserted through aperture 90 into the body of module 20 and then through aperture 96 in bottom surface 50. If the receptacles are data receptacles 65, then receptacle 65 is inserted into aperture 90 and cord 63, with a modular jack, is fed through aperture 96, from bottom surface 50 to the body of module 20, to connect to receptacle 65. Once receptacles 64, 65 and cords 63 are properly inserted, module 20 is placed at the location where module 20 will be located in channel 22. Cords 63 are then placed in channel 22 and fed through aperture 29 to connect to permanent receptacles (not shown) in vertical wall 24 or the floor (not shown) of the work area. Then module 20 is pushed downward into channel 22. As module 20 is pushed into channel 22, flap 32 is pushed downward into channel 22 and into a position where flap 32 abuts the front wall of channel 22. Flap 32 also abuts front surface 48 of protruding portion 49 and is compressed thereby gripping module 20 and maintaining module 20 in the proper position in channel 22.

When module 20 is to be moved, a user may slide module 20 in channel 22 to the desired location, wherein cords 63 may selectively extend through aperture 29 along channel 22 through a gap between bottom surface 50 of module 20 and channel 22. However, if module 20 is to be moved a greater distance, such as from one side of work surface 26 to the other, cords 63 are disconnected from the permanent receptacles and the module 20 is lifted from channel 22 with cords 63 still attached. Cords 63 are then pulled through aperture 29 and removed from channel 22. Once the new location is selected, again, module 20 is placed on flap 32, cords 63 are placed in channel 22 and fed through an aperture 29 for connection to permanent receptacles, and module 20 is pushed into channel 22.

It is to be noted that channel 22 is disposed adjacent at least a portion of the periphery of work surface 26 and that channel 22 may contain several apertures 29 at various locations in channel 22, although only one such aperture 29 is shown in FIG. 7.

Figure 9A:
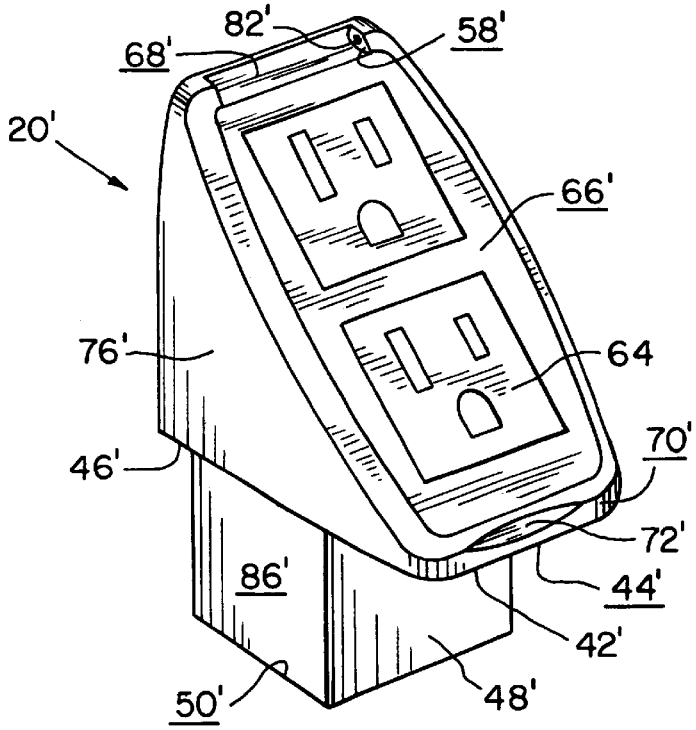
FIG. 9A is a perspective view of a second embodiment of an electrical and data services module in accordance with the present invention, with the cover removed.
Figure 9B:
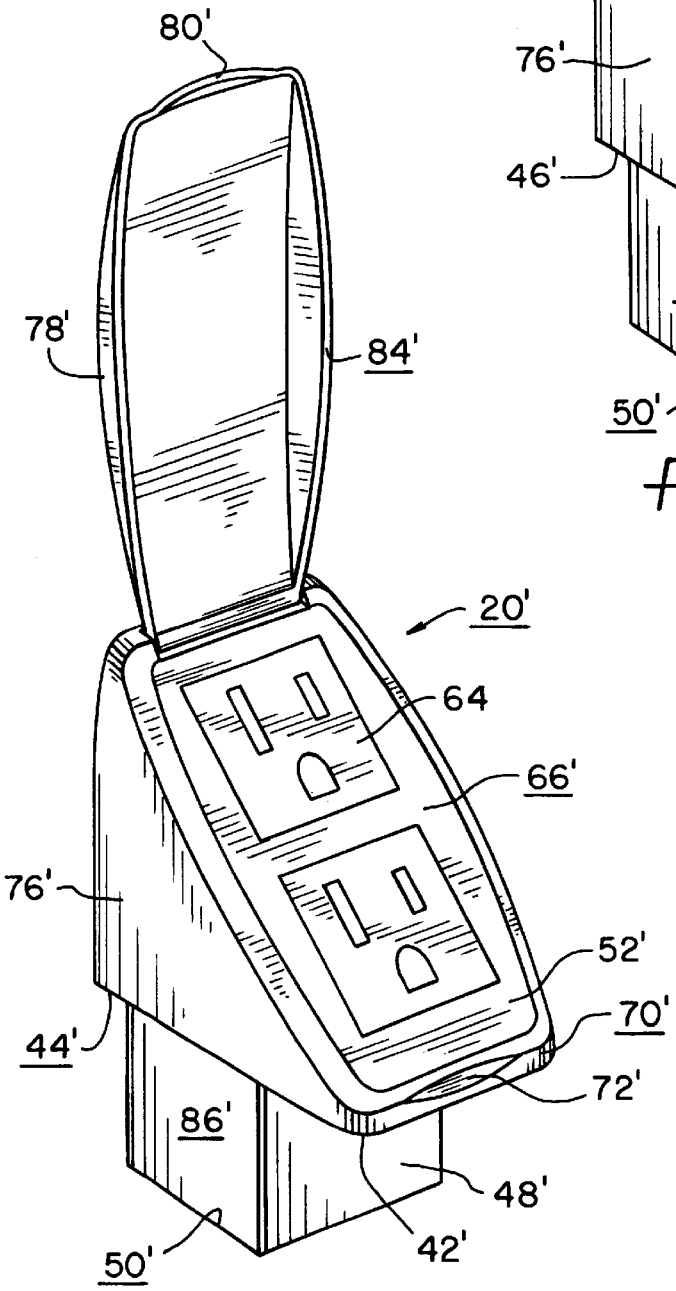
FIG. 9B is a perspective view of a second embodiment of an electrical and data services module, wit the cover attached.

Referring now to FIG. 9A and FIG. 9B, a second embodiment of electrical and data services module 20 is shown, marked as module 20'. Module 20' differs from module 20 in that the configuration of removable receptacles 64 is vertical rather than horizontal. Again, the removable receptacles may be electrical receptacles 64, as shown, or data receptacles 65 or a combination thereof. Module 20' includes a removable cover 78' similar to cover 78, front 52' having surfaces 66' and 70', back 34', top 54', and bottom 42' having two portions 46' and 50'. In all aspects, other than the configuration of the receptacles, modules 20 and 20' are similar in structure and function.

While this invention has been described as having an exemplary process, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A workstation comprising:

a substantially flat work surface;

a substantially vertical wall surface;

a channel disposed between said work surface and said wall surface, said channel adjacent at least a portion of an edge of said work surface; and a movable electrical and data services module having a housing including a first portion having a front surface with at least one aperture therein, a receptacle disposed in said housing and positioned behind said aperture, said housing having a second portion protruding from an underside of said first portion, said second portion disposed within said channel, an electrical or data receptacle disposed within said housing behind said aperture; and said channel further including a flexible flap having a first position wherein said channel is covered and a second position wherein said flap is pushed downwardly within said channel by said second portion of said housing disposed within said channel, said flap maintaining said second portion of said module housing securely in said channel.

2. An electrical and data services module for placement within a recess in a work surface, comprising:

a housing comprising:

a first portion having a substantially planar vertical back surface and a front surface disposed at an acute angle with respect to said back surface, said front surface having at least one aperture therein, said first portion having a first dimension from said back surface to said front surface;

a second portion protruding from an underside of said first portion, said second portion having a substantially planar forwardly facing surface and a substantially planar backwardly facing surface, said second portion having a second dimension from said backwardly facing surface to said forwardly facing surface;

wherein said first dimension is greater than said second dimension such that said first portion extends forwardly of said second portion; and a receptacle disposed within said housing behind said aperture in said front surface.

3. The module of claim 1, further including a cover, said cover hingedly mounted to said first portion of said housing and movable between a first position wherein said receptacle is inaccessible and a second position wherein said receptacle is accessible.

4. An electrical and data services module for placement within a recess in a work surface, comprising:

a housing comprising:

a first portion having a substantially planar vertical back surface and a planar front surface disposed at an acute angle with respect to said back surface, said front surface having at least one aperture therein, said first portion having a first dimension from said back surface to said front surface;

a second portion protruding from an underside of said first portion, said second portion having a substantially planar forwardly facing surface and a substantially planar backwardly facing surface, said second portion having a second dimension from said backwardly facing surface to said forwardly facing surface; and wherein said first dimension is greater than said second dimension such that said first portion extends forwardly of said second portion;

a receptacle disposed within said housing behind said aperture in said front surface; and said second portion further including:

a pair of parallel vertical side surfaces; and curved surfaces disposed respectively between said forwardly facing surface and said side surfaces.

5. The module of claim 4, wherein two of said electrical and data services modules are disposed in a circular grommet hole in a work surface, said back surfaces of said modules in abutting engagement, each said curved surface contacting at least a portion of said grommet hole to thereby pilot each said module in said grommet hole.

6. An electrical and data services module for placement within a recess in a work surface, comprising;

a housing comprising:

a first portion having a substantially planar vertical hack surface and a planar front surface disposed at an acute angle with respect to said back surface, said front surface having at least one aperture therein, said first portion having a first dimension from said back surface to said front surface;

a second portion protruding from an underside of said first portion, said second portion having a substantially planar forwardly facing surface and a substantially planar backwardly facing surface, said second portion having a second dimension from said backwardly facing surface to said forwardly facing surface; and wherein said first dimension is greater than said second dimension such that said first portion extends forwardly of said second portion;

a receptacle disposed within said housing behind said aperture in said front surface; and said second portion further including a bottom having an aperture therein for receipt of cables associated with said receptacle.

7. A workstation comprising:

a work surface;

a substantially vertical wall surface;

channel disposed between said work surface and said wall surface, said channel adjacent at least a portion of an edge of said work surface; and a movable electrical and data services module having a housing including a first portion having a front surface with at least one aperture therein, a receptacle disposed in said housing and positioned behind said aperture, said housing having a second portion protruding from an underside of said first portion, said second portion disposed within said channel; and an electrical or data receptacle disposed within said housing behind said aperture.

8. The workstation of claim 7, and includes a second aperture in said front surface of said first portion of said module housing and a second receptacle in said housing positioned behind said second aperture.

9. The workstation of claim 7, said first portion of said module housing further including a substantially vertical flat back surface abutting said vertical wall surface.

10. The workstation of claim 7, said first portion of said module housing further including a substantially flat bottom surface extending forwardly of said second portion and overhanging said work surface.

11. The workstation of claim 7, wherein said channel has a front to back dimension, and said second portion of said module housing has a front to back dimension substantially the same as the front to back dimension of said channel wherein said second portion closely fits within said channel.

12. In combination:

a work surface;

a substantially vertical wall surface adjacent said work surface;

a space defined between said work surface and said wall surface;

a movable electrical and data services module having a housing including a first portion having a front surface with at least one aperture therein, a receptacle disposed in said housing and positioned behind said aperture, said housing having a second portion protruding from an underside of said first portion, said second portion disposed within said space; and an electrical or data receptacle disposed within said housing behind said aperture.

13. The combination of claim 12, said space further including a channel disposed therein.

14. The combination of claim 12, said first portion of said module housing further including a substantially vertical flat back surface abutting said vertical wall surface.

15. The combination of claim 12, said first portion further including a substantially flat bottom surface extending forwardly of said second portion and overhanging said work surface when said second portion is disposed in said space.

16. The combination of claim 12, wherein said space has a front to back dimension, and said second portion of said module housing has a front to back dimension substantially the same as the front to back dimension of said space wherein said second portion closely fits within said space.

17. In combination, a work surface;

a substantially vertical wall surface adjacent said work surface;

a space defined between said work surface and said wall surface;

a movable electrical and data services module having a housing including a first portion having a front surface with at least one aperture therein, a receptacle disposed in said housing and positioned behind said aperture, said housing having a second portion protruding from an underside of said first portion, said second portion disposed within sad space; and an electrical or data receptacle disposed within said housing behind said aperture; and said space further including a channel disposed therein;

said channel further including a flexible flap having a first position wherein said channel is covered and a second position wherein said flap is pushed downwardly within said channel by said second portion of said housing disposed within said channel, said flap maintaining said second portion securely in said channel.

* * * * *

UNITED STATES PATENT AND TRADEMARK OFFICE

CERTIFICATE OF CORRECTION

PATENT NO. : 6,492,591 B1
DATED : December 10, 2002
INVENTOR(S) : Keith E. Metcalf It is certified that error appears in the above-identified patent and that said Letters Patent is hereby corrected as shown below:

Column 8,
Line 32, before "channel" insert -- a --

Column 10,
Line 12, delete "sad" and substitute therefor -- said --

Signed and Sealed this

Tenth Day of June, 2003

JAMES E. ROGAN
*Director of the United States Patent and Trademark Office*